US010278513B2

(12) United States Patent
Kostyniak et al.

(10) Patent No.: US 10,278,513 B2
(45) **Date of Patent: *May 7, 2019**

(54) CONVERTIBLE HIGH CHAIR

(71) Applicant: KIDS II, INC., Atlanta, GA (US)

(72) Inventors: Jessica Kostyniak, Roswell, GA (US); Jacob Sclare, Dacula, GA (US); Daniel Corso, Atlanta, GA (US)

(73) Assignee: KIDS II, INC., Atlanta, GA (US)

( * ) Notice: Subject to any disclaimer, the term of this patent is extended or adjusted under 35 U.S.C. 154(b) by 18 days.

This patent is subject to a terminal disclaimer.

(21) Appl. No.: 15/670,170

(22) Filed: Aug. 7, 2017

(65) Prior Publication Data

US 2017/0340135 A1 Nov. 30, 2017

Related U.S. Application Data

(63) Continuation of application No. 14/742,132, filed on Jun. 17, 2015, now Pat. No. 9,883,749, which is a (Continued)

(51) Int. Cl.
*A47D 1/00* (2006.01)
*A47D 1/10* (2006.01)

(52) U.S. Cl.
CPC ..... *A47D 1/004* (2013.01); *A47D 1/00* (2013.01); *A47D 1/10* (2013.01)

(58) Field of Classification Search
CPC ... A47D 1/00; A47D 1/04; A47D 1/10; A47C 3/04; A47C 7/024
See application file for complete search history.

(56) References Cited

U.S. PATENT DOCUMENTS 2,731,072 A * 1/1956 Post ..... A47D 1/00 248/188.5
4,750,783 A 6/1988 Irby et al.
(Continued)

FOREIGN PATENT DOCUMENTS

CA 2635892 A1 12/2008
CN 101352293 A 1/2009
(Continued)

OTHER PUBLICATIONS

State Intellectual Property Office of the P.R.C.; First Notification to Make Rectification for Application No. 201220468533.9; dated Jan. 16, 2013; 3 pgs.

*Primary Examiner* — Philip F Gabler
(74) *Attorney, Agent, or Firm* — Gardner Groff Greenwald & Villanueva, PC

(57) ABSTRACT

Various embodiments of the present invention are directed to a convertible children's high chair. According to various embodiments, the convertible high chair generally comprises a first child seat supported above a floor by a high chair frame, and a second child seat configured for being removably coupled to first child seat. The second child seat is configured such that, when detached from the high chair's first child seat, it can be used apart from the high chair as a booster seat (e.g., secured to the seating surface of a standard chair or another support surface). In certain embodiments, the second child seat includes a base surface configured to stably support the second child seat on a separate support surface (e.g., without the need to be attached to or mounted on a separate base or support member).

25 Claims, 7 Drawing Sheets

Related U.S. Application Data continuation of application No. 13/614,863, filed on Sep. 13, 2012, now Pat. No. 9,101,225.

(60) Provisional application No. 61/533,972, filed on Sep. 13, 2011.

(56) References Cited

U.S. PATENT DOCUMENTS

| | | | | |
|---|---|---|---|---|
| 5,348,374 | A | 9/1994 | Kuo | |
| 5,806,922 | A | 9/1998 | Mendelovich | |
| 5,947,555 | A | 9/1999 | Welsh, Jr. et al. | |
| 5,951,102 | A | 9/1999 | Poulson et al. | |
| 5,984,791 | A | 11/1999 | Fair et al. | |
| 6,010,184 | A | 1/2000 | Lee et al. | |
| 6,050,643 | A | 4/2000 | Kain et al. | |
| 6,074,007 | A | 6/2000 | Helmsderfer et al. | |
| 6,082,814 | A | 7/2000 | Celestina-Krevh et al. | |
| 6,089,653 | A | 7/2000 | Hotaling et al. | |
| 6,203,102 | B1 | 3/2001 | Helmsderfer et al. | |
| 6,224,148 | B1 | 5/2001 | Lee et al. | |
| 6,237,996 | B1 | 5/2001 | Chen et al. | |
| 6,619,734 | B2 | 9/2003 | Helmsderfer | |
| 6,659,544 | B2 | 12/2003 | Hollett et al. | |
| 6,676,213 | B1 | 1/2004 | Dlugos | |
| 6,719,371 | B2 | 4/2004 | Yoshie et al. | |
| 6,832,813 | B2 | 12/2004 | Tomas et al. | |
| 7,011,368 | B2 | 3/2006 | Barth et al. | |
| 7,673,934 | B2 | 3/2010 | Bearup et al. | |
| 7,695,060 | B2 | 4/2010 | Dubiel et al. | |
| 7,918,497 | B2 * | 4/2011 | Keegan | A47D 1/008 297/118 |
| 7,988,228 | B2 | 8/2011 | Cui et al. | |
| 8,162,390 | B2 | 4/2012 | Zhong | |
| 8,240,762 | B2 * | 8/2012 | Herzberg | B60N 2/01 297/239 |
| 8,256,833 | B2 | 9/2012 | Hu et al. | |
| 8,308,229 | B2 | 11/2012 | Galley | |
| 8,308,230 | B2 | 11/2012 | Zhong | |
| 8,567,867 | B2 | 10/2013 | Arnold, IV et al. | |
| 8,646,838 | B2 | 2/2014 | Fiore, Jr. et al. | |
| 9,101,225 | B2 | 8/2015 | Kostyniak et al. | |
| 2010/0201164 | A1 * | 8/2010 | Galley | A47D 1/10 297/130 |
| 2011/0074186 | A1 * | 3/2011 | Zhong | A47D 1/006 297/130 |
| 2011/0181084 | A1 * | 7/2011 | Arnold, IV | A47D 1/002 297/256.16 |
| 2012/0086240 | A1 * | 4/2012 | Tsai | A47D 1/00 297/130 |
| 2013/0241248 | A1 * | 9/2013 | Kostyniak | A47D 1/00 297/130 |
| 2015/0366371 | A1 | 12/2015 | Kostyniak et al. | |

FOREIGN PATENT DOCUMENTS

| | | | |
|---|---|---|---|
| CN | 101711634 | A | 5/2010 |
| EP | 2008550 | A1 | 12/2008 |
| EP | 2206453 | A1 | 7/2010 |
| WO | 2008044009 | A1 | 4/2008 |

* cited by examiner

CONVERTIBLE HIGH CHAIR

CROSS-REFERENCE TO RELATED APPLICATIONS

This application is a continuation of U.S. Non-Provisional patent application Ser. No. 14/742,132 filed Jun. 17, 2015, which is a continuation of U.S. Non-Provisional patent application Ser. No. 13/614,863 filed Sep. 13, 2012, which claims priority from provisional U.S. Application No. 61/533,972 filed Sep. 13, 2011; each of which is herein incorporated by reference in its entirety.

BACKGROUND OF THE INVENTION

Field of the Invention

Various embodiments of the present invention described herein generally relate to children's high chairs.

Description of Related Art

Conventional children's high chairs typically include a child seat elevated above a floor by a frame. Certain high chairs, however, are provided with an additional seat that can be removably secured to the high chair's child seat in order to convert the high chair for use by children of different ages. As an example, U.S. Pat. No. 7,673,934 to Bearup et al describes a high chair having a seat member and a separate infant booster seat that can be removably secured to the high chair's seat member. As such, the high chair is convertible into multiple configurations: the high chair and seat member alone, the high chair with the booster seat secured to the seat member, and the booster seat alone. When the booster seat is detached from the high chair, it must be coupled to a separate base member and can then be secured to a standard chair for use as a booster.

However, there remains a need in the art for an improved convertible high chair that is easier and more convenient for users to convert and that includes a removable booster seat capable of stably supporting itself on a support surface (e.g., a standard chair) without the need to be secured to a separate component (e.g., a separate base member).

BRIEF SUMMARY OF THE INVENTION

Various embodiments of the present invention are directed to a convertible children's high chair. In various embodiments, the convertible high chair comprises: a frame configured for resting on a floor; a first child seat defining a first seating surface, the first child seat being coupled to the frame and supported above the floor; and a second child seat defining a second seating surface, the second child seat configured for being removably coupled to at least one of the first child seat and the frame. In various embodiments, the second child seat defines a base surface configured for resting directly on a support surface and supporting the second child seat on the support surface when the second child seat is decoupled from the first child seat and the frame.

In addition, according to certain embodiments of the present invention, the surface profile of the second child seat's base surface is substantially complimentary to the surface profile of the first seating surface; and the second child seat is configured such that, when the second child seat is coupled to the first child seat, the second child seat's base surface engages the first seating surface. In further embodiments, the first child seat defines upwardly extending shoulders on lateral sides of the first seating surface; and, when the second child seat is coupled to the first child seat, at least a portion of the base surface of the second child seat is positioned securely between the first child seat's shoulders.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Various embodiments of the present invention are directed to a convertible children's high chair. According to various embodiments, the convertible high chair generally comprises a first child seat supported above a floor by a high chair frame, and a second child seat configured for being removably coupled to first child seat. The second child seat is configured such that, when detached from the high chair's first child seat, it can be used apart from the high chair as a booster seat (e.g., secured to the seating surface of a standard chair or another support surface).

In certain embodiments, the convertible high chair is adapted such that it can be converted for use by children of varying ages. For example, in one embodiment, the high chair's first child seat may be configured as a toddler seat dimensioned for toddler-age children. As such, when the second child seat is detached, the high chair functions in a first configuration as a toddler high chair. In addition, the second child seat may be configured as an infant booster seat dimensioned for infant-age children. As such, when the second child seat is coupled to the first child seat, the high chair functions in a second configuration as an infant high chair. In such embodiments, the second child seat may also include a base surface configured to stably support the second child seat on a separate support surface (e.g., without the need to be attached to or mounted on a separate base or support member). As such, when the second child seat is detached, it may function on its own in a third configuration as an infant booster seat. Exemplary embodiments of such convertible high chairs are described in greater detail below.

Convertible High Chair

Figure 1:
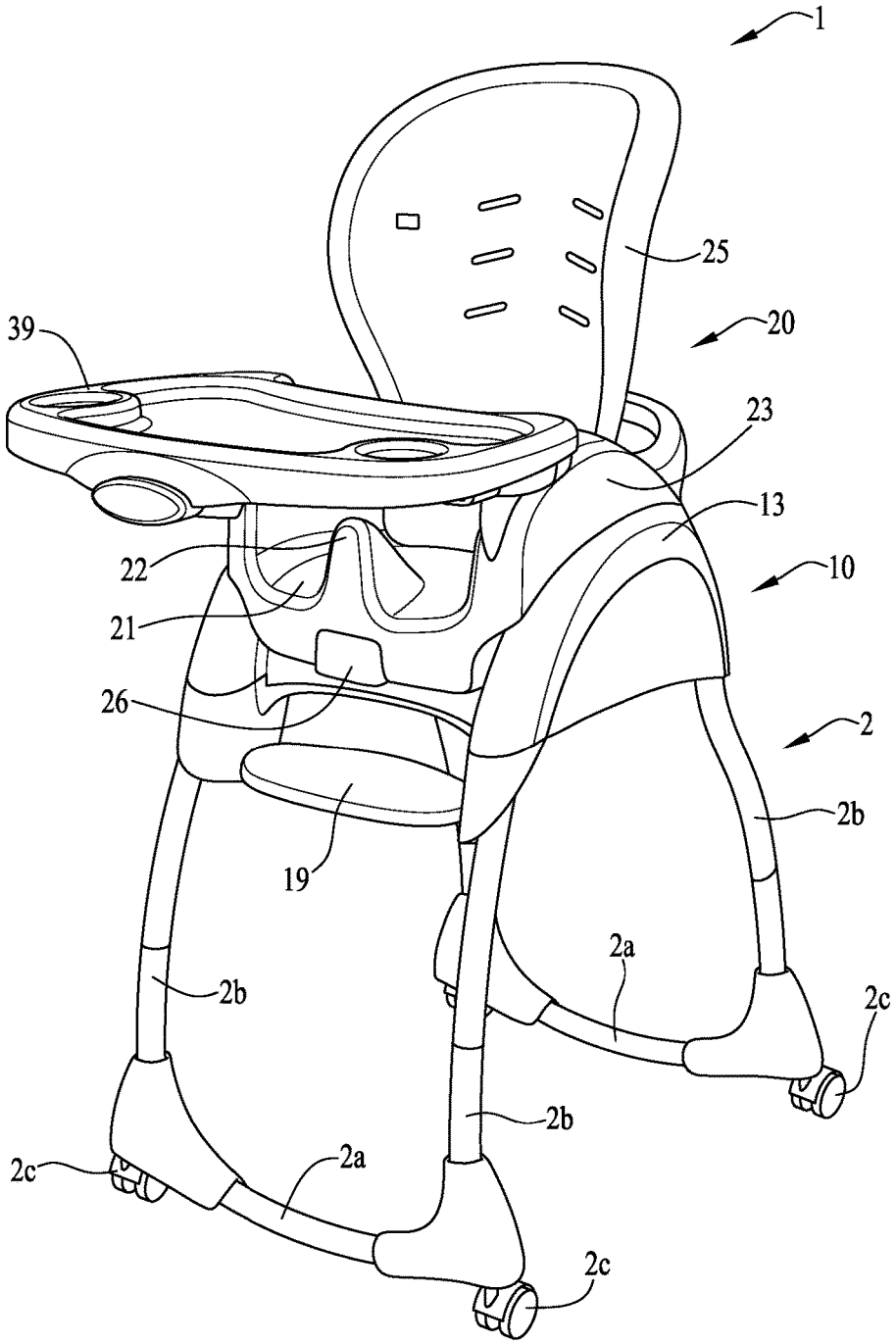
FIG. 1 shows a perspective view of a convertible children's high chair in an infant high chair configuration according to one embodiment of the present invention.

FIG. 1 illustrates a convertible high chair 1 according to one embodiment of the present invention. In the illustrated embodiment, the convertible high chair 1 generally comprises a frame 2, a first child seat 10, and a second child seat 20. As described in greater detail below, the FIG. 1 illustrates the convertible high chair 1 in a first configuration as an infant high chair, in which the second child seat 20 is coupled to the first child seat 10 and thereby supported by the frame 2 in a high chair configuration.

Figure 2:
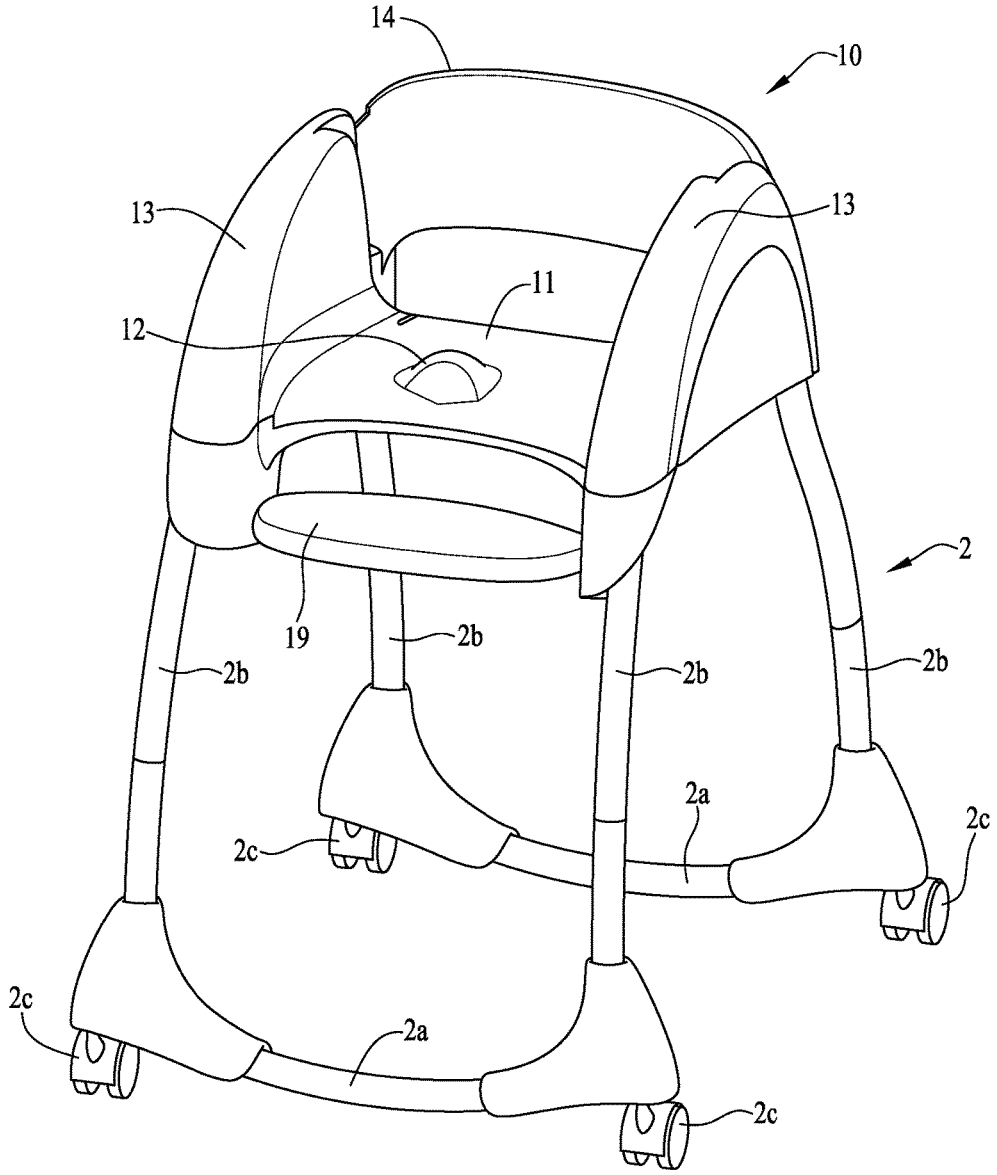
FIG. 2 shows a perspective view of a convertible children's high chair in a toddler high chair configuration according to one embodiment of the present invention.

FIG. 2 illustrates a second configuration in which the convertible high chair 1 is adapted as a toddler high chair (e.g., a restaurant-style high chair). In the configuration of FIG. 2, the second child seat 20 is decoupled from the first child seat 10 and removed from the high chair 1. As shown in FIG. 2, the high chair's frame 2 comprises a pair of base frame members 2*a* from which vertical frame members 2*b* extend upwardly. According to various embodiments, the frame 2 is generally configured for resting on a floor (or other support surface) in order to support the first child seat 10 in an elevated position above the floor. In the illustrated embodiment of FIG. 2, the frame 2 also includes a plurality of wheels 2*c* (e.g., casters) that permit the frame 2 to be rolled by a user along the floor. According to various embodiments, the wheels 2*c* may include brakes for selectively locking the wheels 2*c* and may comprise other sliding or rolling means. In addition, certain embodiments of the frame 2 may be configured to be height adjustable in order to selectively raise or lower the first child seat 10. As an example, in one embodiment, the vertical frame members 2*b* may be telescoping frame members.

As shown in FIG. 2, the first child seat 10 is attached to the vertical frame members 2*b* and supported above the support surface. In the illustrated embodiment, the first child seat 10 defines a first seating surface 11, which includes an upwardly extending crotch restraint 12 configured to prevent a child from sliding off the seating surface 11. The first child seat 10 also includes shoulders 13, which extend upwardly from lateral sides of the first seating surface 11 and function as armrests for a child seated therein. Additionally, the first child seat 10 includes a back rest 14 for supporting the back of a child seated on the first seating surface 11. A foot rest 19 is also secured to upper portions of the vertical frame members 2*b* to support the feet of a child seated in the first child seat 10.

In the illustrated embodiment, the first child seat's seating surface 11, crotch restraint 12, shoulders 13, and back rest 14 are generally dimensioned to accommodate a toddler-age child. As such, the high chair 1 is well suited to function as a toddler high chair in the configuration shown in FIG. 2. However, as will be appreciated from the description herein, various other embodiments of the first child seat 10 may be dimensioned for supporting children of any age.

Figure 3:
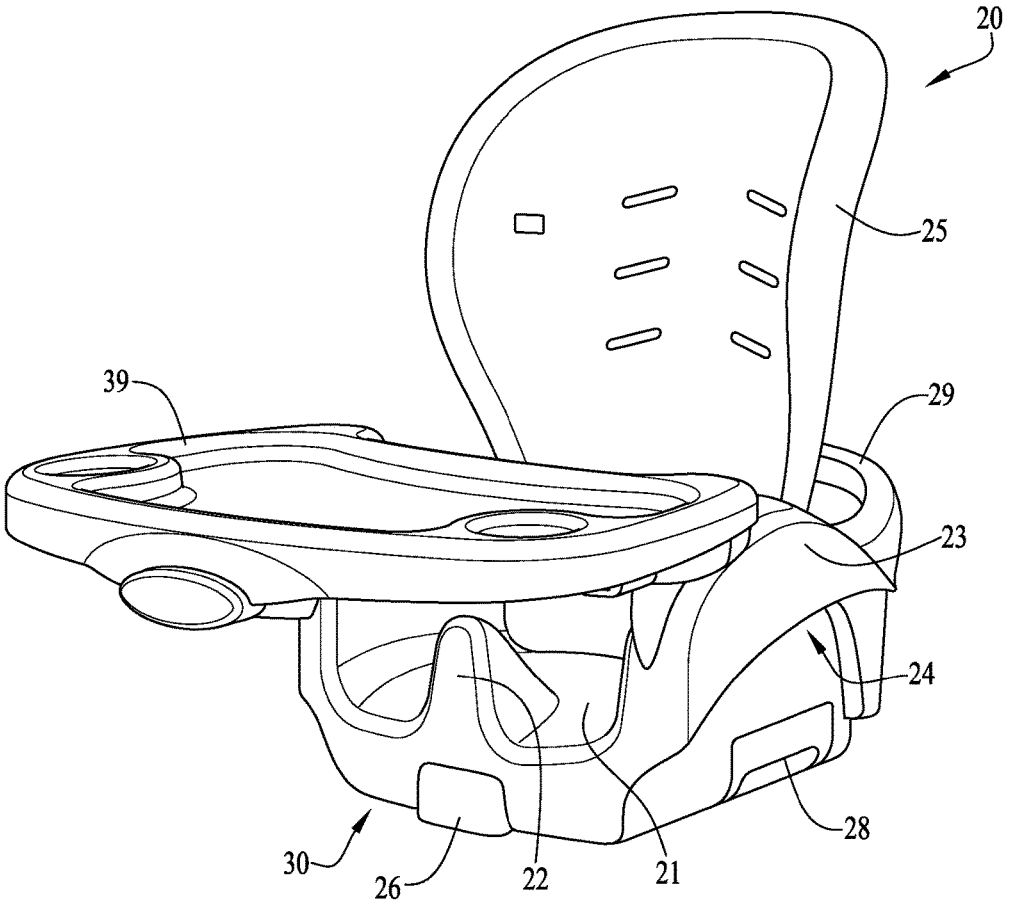
FIG. 3 shows a perspective view of a second child seat in an infant booster seat configuration according to one embodiment of the present invention.

FIG. 3 illustrates a third configuration in which the second child seat 20 is adapted as an infant booster seat. In the configuration of FIG. 3, the second child seat 20 is decoupled from the first child seat 10 and configured for use apart from the high chair 1. As shown in FIG. 3, the second child seat 20 defines a second seating surface 21, which includes an upwardly extending crotch restraint 22 configured to prevent a child from sliding off the seating surface 21. The second child seat 20 also includes shoulders 23, which extend upwardly from lateral sides of the second seating surface 21 and function as armrests for a child seated therein. Additionally, the second child seat 20 includes a back rest 25 for supporting the back of a child seated on the second seating surface 21. In certain embodiments, the back rest 25 may be reclineable and/or removable. Furthermore, the second child seat 20 includes a rear handle 29 configured to provide an easy gripping surface for a user to grasp and move the second child seat 20. In certain embodiments, the rear handle 29 may also serve as a stop for the back rest 25 and may assist a user in locating the second child seat 20 on an adult chair by spacing it an appropriate distance from the back rest of the adult chair. Additionally, according to certain embodiments, the rear handle 29 may be adapted to receive or otherwise engage the first child seat's back rest 14.

In the embodiment of FIG. 3, the second child seat 20 also includes a tray 39 coupled to the shoulders 23 and adapted to restrain a child seated in the second child seat 20. In certain embodiments, the tray 39 may be configured to pivot in a horizontal plane about one or both of the shoulders 23. However, other embodiments of the tray 39 may be alternatively constructed (e.g., the tray 39 may be removably attached to the shoulders 23 by means of snaps, hooks, or other conventional fasteners). The second child seat 20 may also be provided with a seatbelt or harness to further secure a child positioned therein.

Figure 4:
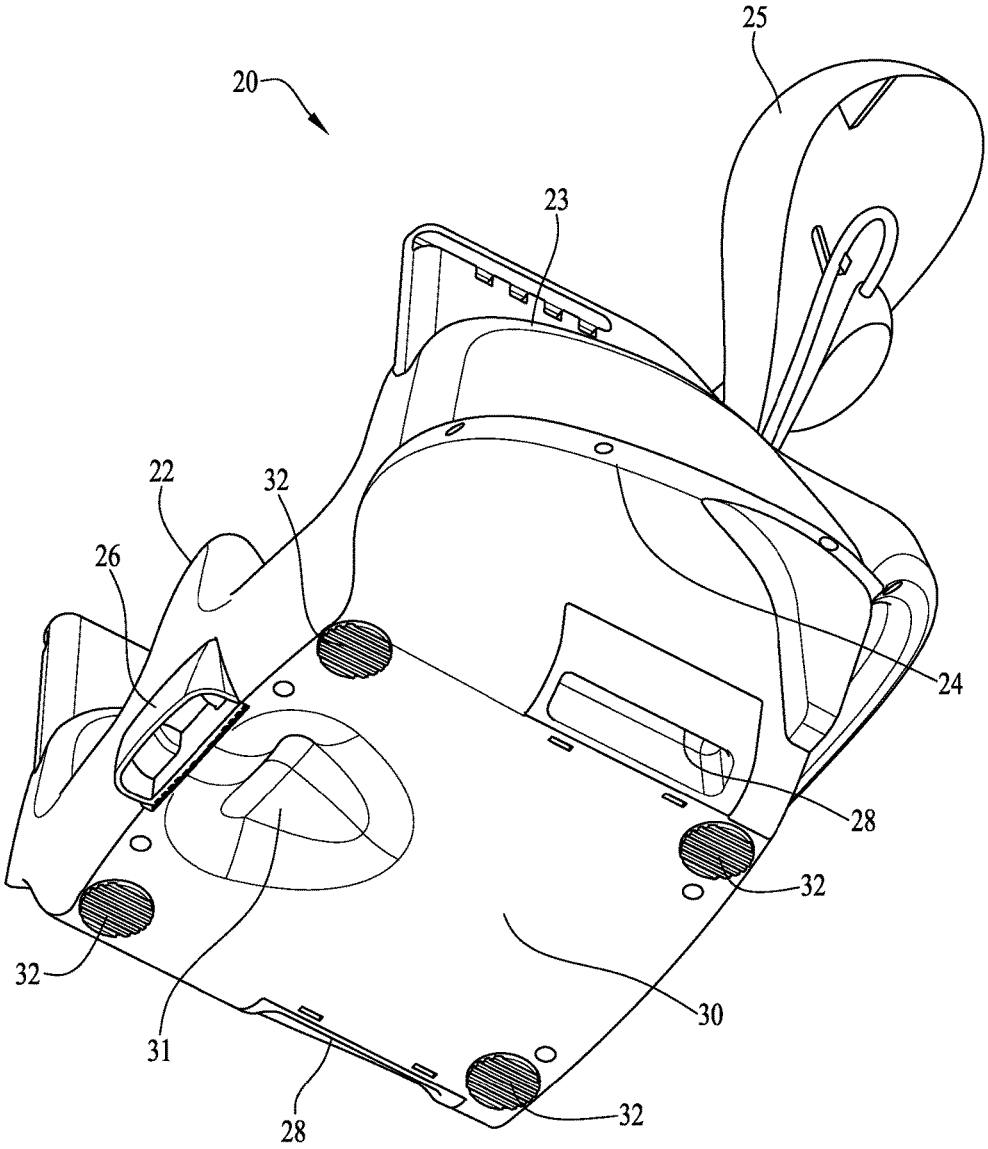
FIG. 4 shows a bottom-left perspective view of the second child seat according to one embodiment of the present invention.
Figure 5:
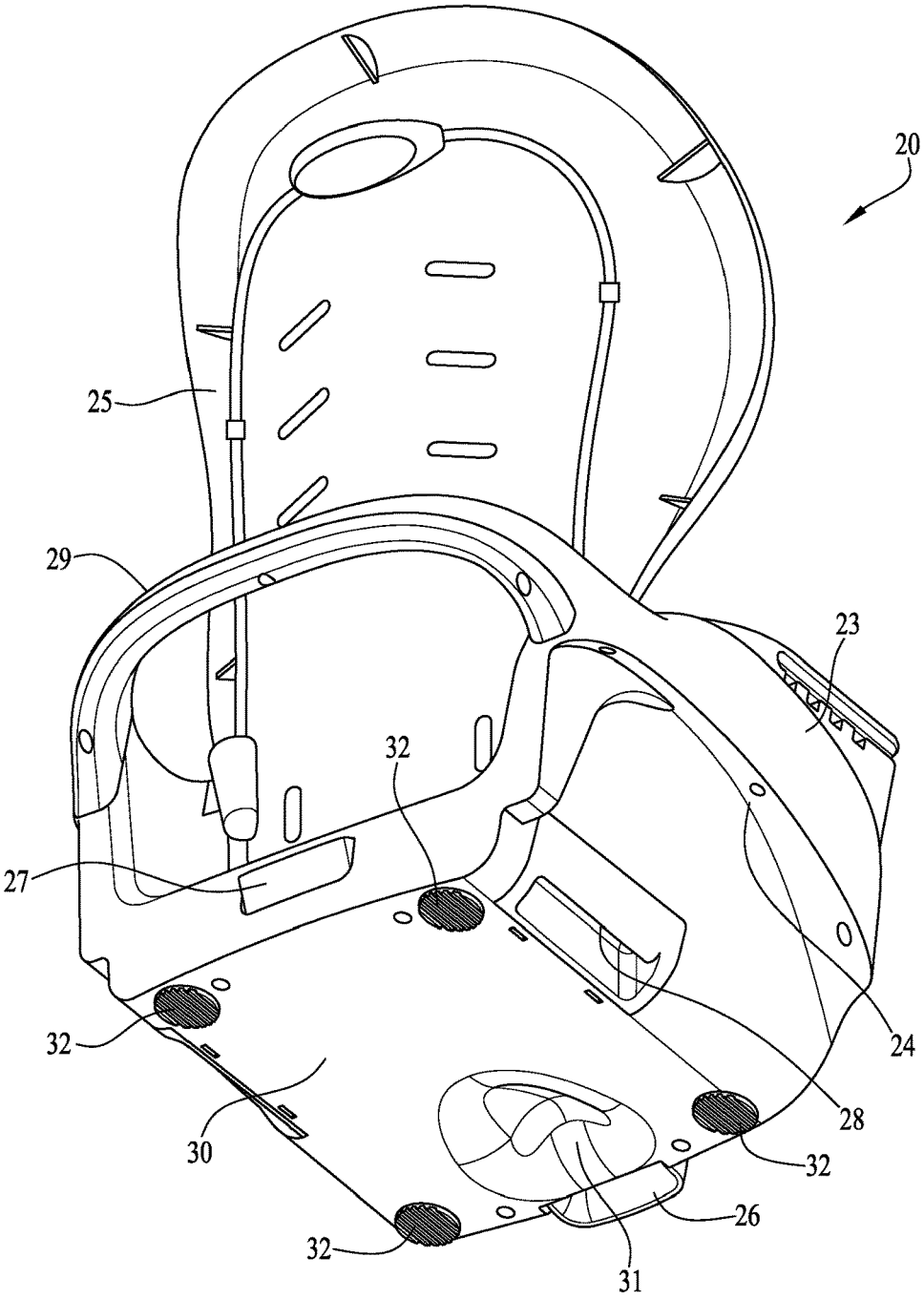
FIG. 5 shows a bottom-right perspective view of the second child seat according to one embodiment of the present invention.
Figure 6:
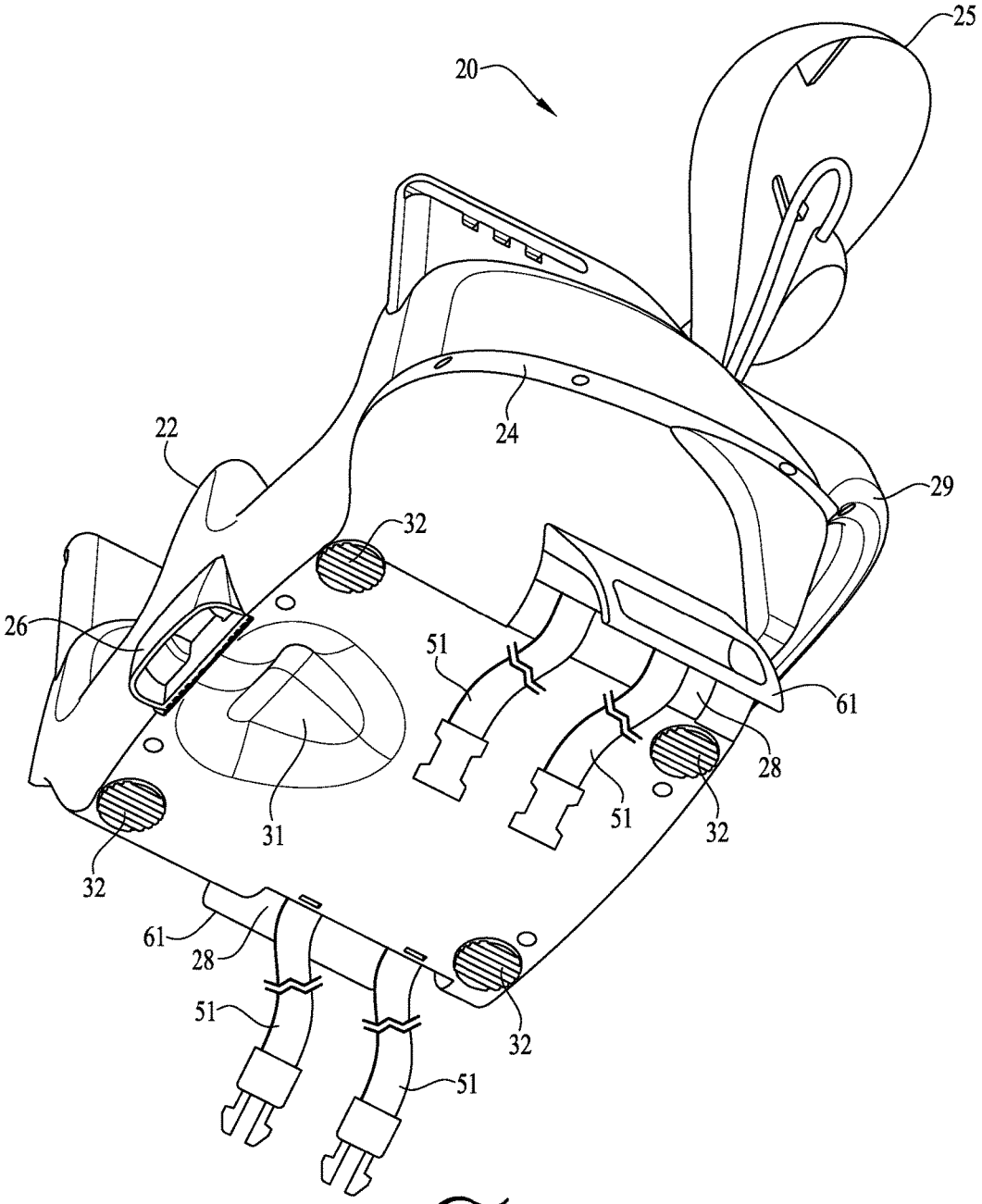
FIG. 6 shows a bottom-left perspective view of the second child seat according to one embodiment of the present invention.
Figure 7:
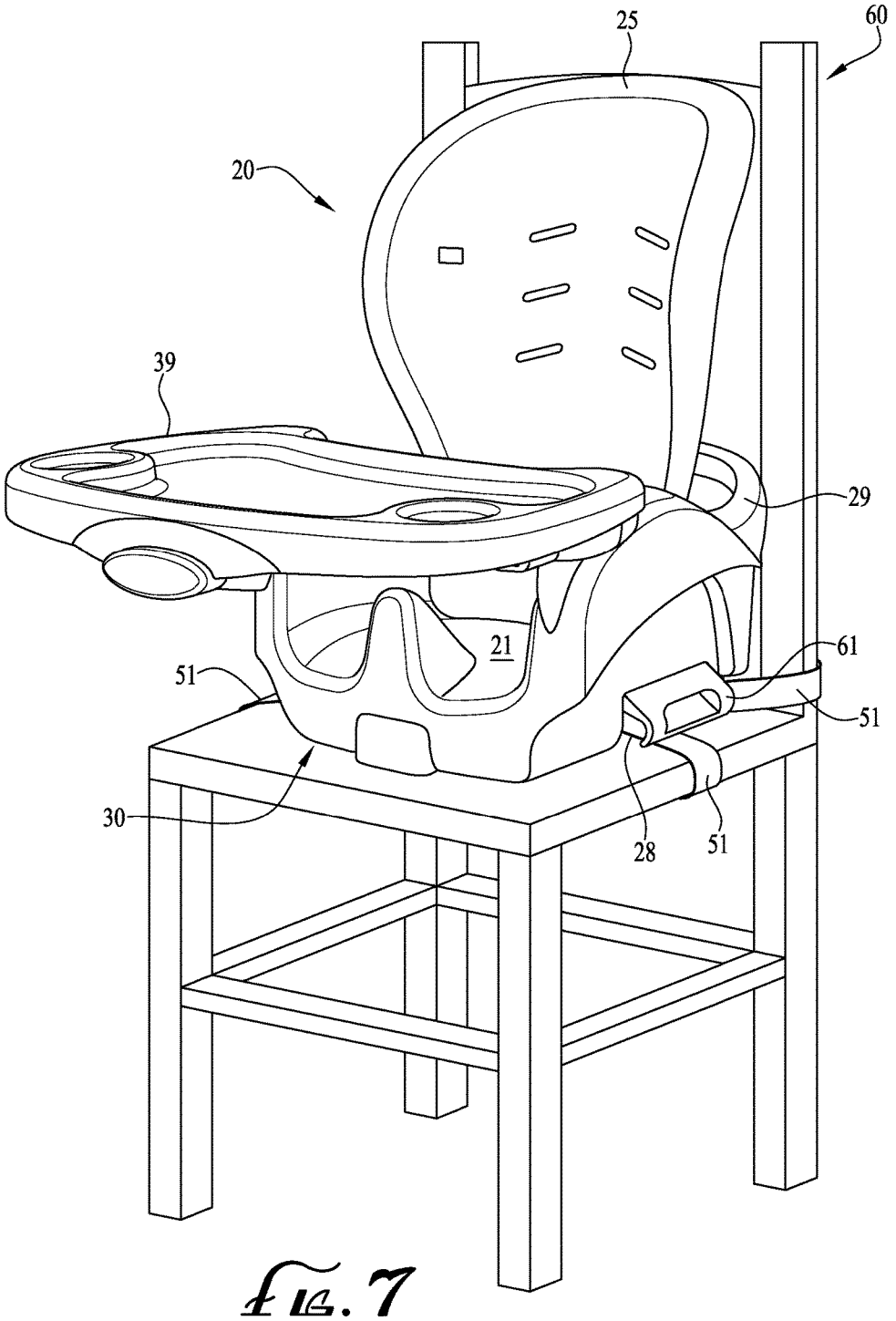
FIG. 7 shows a perspective view of the second child seat secured to a chair.

In addition, the second child seat 20 includes a pair of storage compartments 28 on its lateral sides adjacent the second child seat's base surface 30 (shown in FIGS. 4 and 5). In the illustrated embodiment, the storage compartments 28 are configured with a hinged door 61 and are configured for storing straps 51 (e.g., as shown in FIG. 6) for use in securing the second child seat 20 to a chair 60 (e.g., as shown in FIG. 7) or other support surface when used as a booster seat. In certain embodiments, the second child seat 20 is configured such that the second child seat 20 may not be coupled to the first child seat 10 unless the storage compartments 28 are closed (e.g., as can be appreciated from the fit of the second child seat 20 in the first child seat 10 shown in FIG. 1 and the obstructing open position of the storage compartment's hinged door 61 shown in FIGS. 6 and 7). In such embodiments, this may function as a safety feature to ensure the straps 51 are contained within the storage compartments 28 when the second child seat 20 is coupled to the first child seat 10, thereby preventing the straps 51 from hanging down from the seats 10, 20 (e.g., such that a sibling or other child could grab them or they could interfere with the seats 10, 20 securely locking together).

FIG. 4 shows a bottom view of the second child seat 20 as viewed from the seat's left side, while FIG. 5 provides a bottom view of the second child seat 20 as viewed from the seat's right side. As shown in FIGS. 4 and 5, the second child seat 20 defines a bottom base surface 30. In the illustrated embodiment, the base surface 30 has a surface profile that is generally complimentary to that of the first child seat's first seating surface 11. As such, the base surface 30 is substantially flat, but includes a recessed portion 31 dimensioned for receiving at least a portion of the first child seat's crotch restraint 12. In addition, the base surface 30 includes four non-slip pads 32 positioned at corners of the base surface 30. According to various embodiments, the non-slip pads 32 may comprise rubber strips or another material suitable for gripping a support surface.

In the illustrated embodiment, the second child seat's seating surface 21, crotch restraint 22, shoulders 23, and back rest 25 are generally dimensioned to accommodate an infant-age child. As such, the second child seat 20 is well suited to function as an infant booster seat in the configuration shown in FIGS. 3-5. In particular, the second child seat's base surface 30 provides a stable platform on which the second child seat may rest when placed on a separate support surface, such a dining chair 60 (e.g., as shown in FIG. 7). As such, the second child seat 20 can be stably placed on a separate support surface without the need to be attached to or mounted on a separate base or support member. As discussed below, in the illustrated embodiment, the second child seat's base surface 30 is also dimensioned to nest within the first child seat 10, thereby providing the base surface 30 with a relatively narrow surface area profile suitable for being placed on the seating surface of an adult chair (e.g., such that the edges of the base surface 30 do not hang over the edges of a typical adult chair's seating surface). In addition, the base surface's non-slip pads 32 provide additional stability when placed on support surfaces. Moreover, the straps 51 contained in the storage compartments 28 enable the second child seat 20 to be securely attached to a chair 60 (e.g., as shown in FIG. 7) or other support surface. As will be appreciated from the description herein, various other embodiments of the second child seat 20 may be dimensioned for supporting children of any age.

As noted above, the second child seat 20 is also configured for being removably coupled to the first child seat 10 (e.g., in the infant high chair configuration of FIG. 1). In particular, as shown in FIG. 1, the second child seat's base surface 30 is dimensioned to fit within the first child seat's shoulders 13 and rest on the first child seat's seating surface 11. As the base surface 30 has a surface profile complimentary to that of the seating surface 11, the second child seat 20 fits securely on top of the first child seat 10. The base surface's non-slip pads 32 also enhance the secure fit of the second child seat 20 on the first child seat 10 by gripping the seating surface 11. In addition, the second child seat's shoulders 23 define recessed bottom surfaces 24 (shown in FIGS. 4 and 5), which are dimensioned to receive the first child seat's shoulders 13 when the second child seat 20 is coupled to the first child seat 10. This also enhances the fit between the second child seat 20 and the first child seat 10.

In the illustrated embodiment of FIGS. 3-5, the second child seat 20 also includes a locking mechanism comprising a spring-loaded ridge 27 and a release handle 26. In the illustrated embodiment, the spring-loaded ridge 27 is positioned at the rear of the second child seat 20 and is configured to engage a lip on the first child seat 10 when the second child seat 20 is coupled to the first child seat 10, thereby locking the second child seat 20 to the first child seat 10. To release the second child seat 20 from the first child seat 10, the ridge 27 can be actuated by pulling the release handle 26, which retracts the ridge 27 and enables the second child seat 20 to be removed from the first child seat 10.

As will be appreciated from the description herein, the configuration of the convertible high chair 1 enables a user to easily convert the high chair 1 between an infant high chair configuration, a toddler high chair configuration, and an infant booster seat configuration. In addition, the high chair's second child seat 20 is especially well suited for use on its own as a booster seat, without the need to be attached to additional base or support members. According to various embodiments, this ability enhances the convenience for a user in converting the high chair 1, reduces the manufacturing cost of the high chair 1, and improves the overall reliability of the high chair 1.

Various Other Embodiments

As will be appreciated from the description herein, various changes and modifications to the convertible high chair 1 are contemplated as being within the scope of the present invention. For example, as will be appreciated from the description herein, the first child seat 10 may be permanently attached to the frame 2, or removably coupled to the frame 2. In addition, in various embodiments, the second child seat 20 may configured for being coupled to the first child seat 10, the frame 2, or both when in the infant high chair configuration of FIG. 1 (e.g., where the frame defines shoulder portions of the first child seat or fully defines the first child seat).

Additionally, in certain embodiments, the bottom surface 30 of the second child seat 20 may not be complimentary to the first seating surface 11. As an example, in one embodiment, the bottom surface 30 defines protruding portions where the non-slip pads 32 are located that may act as feet for the second child seat 20. In such embodiments, the second child seat 20 may be configured to be coupled to the first child seat 10 and for use as a boost seat on its own in a manner analogous to that described above. In addition, as will be appreciated from the description herein, various features of the of the first child seat 10 and second child seat 20 described herein may be omitted in other embodiments (e.g., footrests, back rests, non-slip pads, etc.). In addition, according to various other embodiments, both of the child seats 10, 20 may be adapted for use by infants, toddlers, or young children.

CONCLUSION

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A convertible high chair convertible between a high chair configuration and a booster seat configuration, the convertible high chair comprising:

a first seating assembly comprising a support frame and a first child seat mounted to the support frame, the support frame comprising a pair of front leg frame members extending downwardly from the first child seat, and a pair of back leg frame members extending downwardly from the first child seat; and a second child seat configured for use in the high chair configuration and in the booster seat configuration, wherein the second child seat is detachably coupled to the first child seat with a base portion of the second child seat supported over the first child seat in the high chair configuration, and wherein the second child seat is detached from the first child seat with the base portion of the second child seat configured to rest directly on a generally flat support surface and support the second child seat in a stable upright position on the generally flat support surface in the booster seat configuration.

2. The convertible high chair of claim 1, wherein the first child seat comprises a first seating surface for supporting a child seated thereon, a backrest extending upwardly from the first seating surface at the back portion of the first child seat, and first and second side shoulders extending upwardly from opposite sides of the first seating surface and extending from the backrest toward the front portion of the first child seat, defining a first seating area above the first seating surface and between the first and second side shoulders; and wherein the base portion of the second child seat is positioned in the first seating area and between the first and second side shoulders in the high chair configuration.

3. The convertible high chair of claim 2, wherein the second child seat comprises a second seating surface for supporting a child seated thereon, and first and second mounting shoulders extending along opposite sides of the second seating surface, the first and second mounting shoulders of the second child seat having recessed bottom surfaces dimensioned to receive the first and second side shoulders of the first child seat in the high chair configuration.

4. The convertible high chair of claim 1, wherein the base portion of the second child seat comprises non-slip pads that are supported over the first child seat in the high chair configuration, and that rest directly on the flat support surface in the booster seat configuration.

5. The convertible high chair of claim 1, wherein the flat support surface is a seat of a standard adult chair.

6. The convertible high chair of claim 1, further comprising at least one spring-loaded lock and release mechanism for releasably locking the second child seat to the first child seat in the high chair configuration.

7. The convertible high chair of claim 1, further comprising wheels at lower ends of at least one of the pair of front leg frame members and the pair of back leg frame members.

8. The convertible high chair of claim 1, further comprising a footrest extending between the pair of front leg frame members of the support frame beneath the first child seat.

9. The convertible high chair of claim 1, further comprising a tray for removable attachment to the second child seat.

10. A convertible high chair comprising:

a first child seat comprising a first seating surface for supporting a child seated thereon, a backrest extending upwardly from the first seating surface along a back portion of the first child seat, and first and second side shoulders extending upwardly from opposite sides of the first seating surface and extending from the backrest toward a front portion of the first child seat, defining a first seating area above the first seating surface and between the first and second side shoulders;

a support frame comprising a pair of front legs extending from the first child seat and a pair of back legs extending from the first child seat, for supporting the first child seat at an elevated position; and a second child seat comprising a base portion dimensioned to nest within the first seating area of the first child seat between the first and second side shoulders in a first seating configuration with the second child seat detachably mounted to the first child seat, and wherein the base portion of the second child seat further comprises a plurality of non-slip pads for supporting the second child seat on a separate support surface in a second seating configuration with the second child seat detached from the first child seat.

11. The convertible high chair of claim 10, wherein the second child seat further comprises a second seating surface for supporting a child seated thereon, and first and second mounting shoulders extending along opposite sides of the second seating surface, the first and second mounting shoulders of the second child seat having recessed bottom surfaces dimensioned to receive the first and second side shoulders of the first child seat in the first seating configuration.

12. The convertible high chair of claim 10, wherein the plurality of non-slip pads are configured to rest directly on the separate support surface and support the second child seat in a stable upright position in the second seating configuration.

13. The convertible high chair of claim 12, wherein the separate support surface is a generally flat seat of a standard adult chair.

14. The convertible high chair of claim 10, further comprising at least one spring-loaded lock and release mechanism for releasably locking the second child seat to the first child seat in the first seating configuration.

15. The convertible high chair of claim 10, further comprising wheels at lower ends of at least one of the pair of front legs and the pair of back legs.

16. The convertible high chair of claim 10, further comprising a footrest extending between the pair of front legs of the support frame beneath the first child seat.

17. The convertible high chair of claim 10, further comprising a tray for removable attachment to the second child seat.

18. A convertible high chair comprising:

a first seat mounted to a frame, the first seat comprising a first seat surface for supporting a child seated thereon, and further comprising sidewalls extending upwardly from opposite lateral sides of the first seat surface; and a second seat comprising an upper portion having shoulders defining recessed bottom surfaces configured to engage over the sidewalls of the first seat in a first configuration of the high chair, the second seat further comprising a lower portion configured for detachable engagement with the first seat in the first configuration of the high chair and for supporting the second seat in a stable upright position on a support surface in a second configuration of the high chair with the second seat detached from the first seat.

19. The convertible high chair of claim 18, wherein the lower portion of the second seat comprises non-slip pads that are supported over the first seat surface in the first configuration of the high chair, and that rest directly on the support surface in the second configuration of the high chair.

20. The convertible high chair of claim 18, wherein the support surface is a generally flat seat of a standard adult chair.

21. The convertible high chair of claim 18, further comprising at least one spring-loaded lock and release mechanism for releasably locking the second seat to the first seat in the first configuration of the high chair.

22. The convertible high chair of claim 18, wherein the frame comprises a first base frame member having first and second ends, a first pair of upward frame members extending upwardly from the first and second ends of the first base frame member, a second base frame member having first and second ends, and a second pair of upward frame members extending upwardly from the first and second ends of the second base frame member.

23. The convertible high chair of claim 22, further comprising wheels positioned adjacent the first and second ends of at least one of the first and second base frame members.

24. The convertible high chair of claim 18, further comprising a footrest extending between front legs of the frame beneath the first seat.

25. The convertible high chair of claim 18, further comprising a tray for removable attachment to the second seat.

* * * * *